United States Patent [19]

Kuwamoto et al.

[11] Patent Number: 4,663,061

[45] Date of Patent: May 5, 1987

[54] METAL-WORKING OIL COMPOSITION

[75] Inventors: Hiroshi Kuwamoto, Fukuyama; Hiroyuki Nagamori; Takashi Mukai, both of Wakayama; Shuichi Iwado; Yoshihiro Sakaguchi, both of Fukuyama, all of Japan

[73] Assignees: Kao Corporation; Nippon Kokan Kabushiki Kaisha, both of Tokyo, Japan

[21] Appl. No.: 617,572

[22] Filed: Jun. 5, 1984

[30] Foreign Application Priority Data

Jun. 14, 1983 [JP] Japan ..... 58-106541
Jun. 15, 1983 [JP] Japan ..... 58-107239

[51] Int. Cl.[4] ..... C10M 149/00; C10M 137/00; C10M 137/00

[52] U.S. Cl. ..... 252/32.5; 252/32.7 E; 252/51.5 A; 252/52 R; 252/49.7; 252/49.9; 252/48.2; 252/47; 252/56 R; 252/45

[58] Field of Search ..... 252/32.7 E, 32.5, 51.5 A, 252/52 R, 49.7, 48.2, 45, 56 R

[56] References Cited

U.S. PATENT DOCUMENTS 4,284,415 8/1981 Kwong et al. ..... 252/51.5 R
4,471,091 9/1984 Hayashi ..... 252/51.5 A
4,490,267 12/1984 Eckert et al. ..... 252/51.5 R
4,510,063 4/1985 Chow et al. ..... 252/51.5 R

*Primary Examiner*—J. V. Howard
*Attorney, Agent, or Firm*—Oblon, Fisher, Spivak, McClelland, & Maier

[57] ABSTRACT

A metal-working oil composition containing the following three components (A), (B) and (C) as its essential components:

(A) one or more lube-oil components selected from the group consisting of oils, fats, mineral oils and fatty acid esters;

(B) a cationic or amphoteric water-soluble polymer compound having a molecular weight of 1,000 to 10,000,000, containing nitrogen atoms in its molecule; and (C) a surfactant.

A metal-working oil composition according to the invention can further and optionally comprise an extreme-pressure additive, which can enhance the lubrication performance. When the metal-working oil composition is brought into contact with a metallic workpiece, oil droplets having a uniform diameter form a thick and strong lubricating film over the workpiece, thus the composition can be successfully employed for processing metals under high shear, high-speed and high-pressure conditions.

8 Claims, No Drawings

METAL-WORKING OIL COMPOSITION

BACKGROUND OF THE INVENTION i. Field of the Invention:

This invention relates to a novel metal-working oil composition, and more particularly to a metal-working oil composition containing a lube-oil component, a specific water-soluble polymer and a surfactant, and optionally in combination with an extreme-pressure additive.

ii. Description of the Prior Art:

Conventional metal-working oils which have generally been used are each obtained by adding lube-oil additives such as an oilness agent, extreme-pressure additve, rust preventive and/or antioxidant to a lube-oil component such as an oil and fat, mineral oil or fatty acid ester and then converting the resultant mixture into an o/w-type emulsion by means of an emulsifier. They are fed to metal-working parts, usually with concentrations of 1 to 20%. In the case of rolling a metal for example, it has however been attempted to increase, namely, speed up the rolling speed so as to achieve mass production, relying upon rapid advancement in rolling facilities and technology which has been achieved in recent years. Reflecting such an attempt, requirements for rolling mill oil such as lubricity, circulation stability, working efficiency and treatment readiness of waste water have become progressively severer. There is thus a strong standing desire for the development of a rolling mill oil which can satisfactorily meet such requirements. However, conventional rolling mill oils which make use of emulsifier are accompanied by various drawbacks and are hence unable to fulfill such requirements. In the case of a conventional rolling mill oil relying upon an emulsifier, the rolling lubricity was controlled by changing the type and amount of the emulsifier in such a way that the amount of the oil which was to adhere on rollers and each workpiece, in other words, the plate-out quantity was either increased or decreased. In such an emulsifier-containing rolling mill oil as described above, there was a problem that the plate-out quantity and the circulation stability of the emulsion showed mutually-contradictory tendency, namely, the plate-out quantity to each workpiece is decreased and the lubricity is thus rendered insufficient if the stability of the emulsion is enhanced. If one tried to increase the plate-out quantity, the emulsion became unstable and developed various problems when circulated for its reuse. Accordingly, conventional rolling mill oils making use of emulsifiers were accompanied by such drawbacks as mentioned above. Forthermore, still further improvements are also desired to the lubricity and working efficiency of other metal-working oils such as press-working oils and cutting oils.

The present inventors therefore carried out a research with a view toward solving the aforementioned drawbacks which conventional emulsion-type metal working-oil had. As a result, it was succeeded to improve the above-described drawbacks by using a lube-oil component, which contained an oil and fat or wax having a melting point of 20° to 100° C., in combination with a specific hydrophilic dispersant (a water-soluble, anionic, polymer compound) in such a way that the lube-oil component was stably suspended and dispersed in a solid form in water at a temperature below the melting point but the resultant dispersion became unstable when fed to each working part, i.e., at a temperature above the melting point. A patent application has been already made on the above finding (see, Japanese patent application Laid-open No. 147593/1980).

SUMMARY OF THE INVENTION

The present inventors have conducted further research, resulting in a findig of a metal-working oil composition which may be successuflly employed for working metals under high shear conditions which are expected to encounter upon an actual application of the oil composition and under high-speed and high-pressure conditions which permit high working speeds and great degrees of working, permits metal machining under severe cutting conditions, and facilitates such process control as excellent liquid circulation stability.

More specifically, the present inventors have found that use of a lube-oil component and a specific water-soluble polymer compound and surfactant, and optionally in combination with an extreme-pressure additive permits first of all stable dispersion of the lube-oil component in water while maintaining uniform droplet size, owing to the protective colloidal functions of both the water-soluble polymer compound and surfactant, and hence the resulting dispersion enjoys good circulation stability; when the metal-working oil composition is supplied to a metal-working part and brought into contact with a metallic workpiece, oil droplets having the uniform diameter form a thick and strong lubricating film over the metallic workpiece; the high lubricity can be enhanced further owing to the action of the extreme-pressure additive present in oil droplets or water; and while circulated and reused for an extended period of time, the sizes of oil droplets can be uniformly and stably maintained against shear forces produced by a stirrer in a tank and by a feed and circulation pump. The present invention has been completed on the basis of the above-described findings.

Accordingly, the present invention provides in one aspect a metal-working oil composition containing the following three components (A), (B) and (C) as its essential components and in another aspect a metal-working oil composition containing an extreme-pressure additive, which is the component (D), as a further component in addition to the three components.

(A) one or more lube-oil components selected from the group consisting of oils, fats, mineral oils and fatty acid esters;

(B) a cationic or amphoteric water-soluble polymer compound having a molecular weight of 1,000 to 10,000,000, containing nitrogen atoms in its molecule and selected from the following groups (a) to (h):

(a) a homopolymer of nitrogen-containing monomer represented by either one of the following general formulae (I) to (IX) or a salt of the monomer, or a copolymer of two or more of the nitrogen-containing monomers or salts of the monomers:

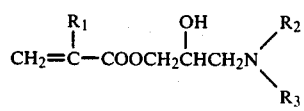

(I)

wherein $R_1$ means H or $CH_3$, and $R_2$ and $R_3$ denote individually H or an alkyl group having 1 to 3 carbon atoms;

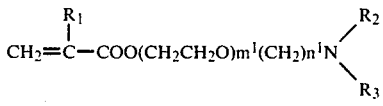

(II)

wherein $m^1$ is a number of 1 to 3, $n^1$ stands for a number of 1 to 3, and $R_1$, $R_2$ and $R_3$ have the same meanings as those defined in Formula (I);

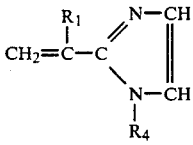

(III)

wherein $R_4$ denotes H or an alkyl or alkylol group having 1 to 3 carbon atoms and $R_1$ has the same meaning as that defined in Formula (I);

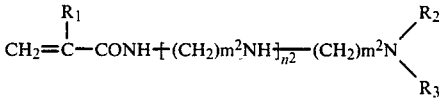

(IV)

wherein $m^2$ is a number of 1 to 3, $n^2$ stands for a number of 0 to 3, and $R_1$, $R_2$ and $R_3$ have the same meanings as those defined in Formula (I);

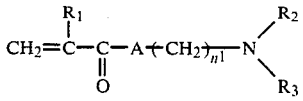

(V)

wherein A means —O— or —NH—, and $R_1$, $R_2$, $R_3$ and $n^1$ have the same meanigs as those defined in Formulae (I) and (II);

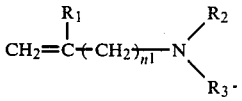

(VI)

wherein $R_1$, $R_2$, $R_3$ and $n^1$ have the same meanings as those defined in Formulae (I) and (II);

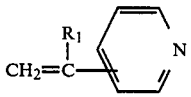

(VII)

wherein $R_1$ has the same meaning as that defined in Formula (I) and the site of substitution on the pyridine ring is at the 2nd- or 4th-position;

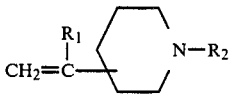

(VIII)

wherein $R_1$ and $R_2$ have the same meanings as those defined in Formula (I) and the site of substitution on the piperidine ring is at the 2nd- or 4th-position; and

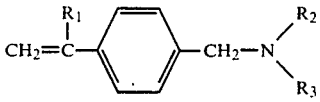

(IX)

wherein $R_1$, $R_2$ and $R_3$ have the same meaninqs as those defined in Formula (I);

(b) a copolymer of one or more of the nitrogen-containing monomers represented respectively by the general formulae (I) to (IX) or salts thereof and one or more vinyl monomers selected from the group consisting of $\alpha,\beta$-unsaturated carboxylic acids and salts and derivatives thereof, sulfo-containing vinyl compounds and salts thereof, acrylonitrile, vinylpyrrolidone, and aliphatic olefins containing 2 to 20 carbon atoms;

(c) a salt or the quaternary ammonium salt of a ring-opened polymer of ethyleneimine;

(d) a salt or the quaternary ammonium salt of a polycondensation product between an aliphatic dicarboxylic acid and polyethylenepolyamine or a dipolyoxyethylenealkylamine;

(e) a dihaloalkane-polyalkylenepolyamine polycondensation product;

(f) an epihalohydrin-amine polycondensation product;

(g) a salt of chitosan, starch or cellulose, or a cation-modified product thereof; or (h) a polyetherpolyol or polyolpolyether derivative obtained respectively by adding an alkylene oxide to a polyalkyleneimine having 6 to 200 nitrogen atoms or a derivative thereof and having a molecular weight of 1,000 to 600,000; and (C) a surfactant.

DETAILED DESCRIPTION OF THE INVENTION AND PREFERRED EMBODIMENTS

As the lube-oil component which is the component (A) of the metal-working oil composition according to this invention, may for example be mentioned a mineral oil such as spindle oil, machine oil, turbine oil or cylinder oil, an animal or vegetable oil and fat such as whale oil, beef tallow, hog fat, rape oil, castor oil, rice bran oil, palm kernel oil or coconut oil, or an ester between a fatty acid obtained from beef tallow, coconut oil, palm oil, castor oil or the like and an aliphatic primary alcohol containing 1 to 22 carbon atoms, ethylene glycol, neopentyl alcohol, pentaerythritol or the like. These components may be used singly. Alternatively, two of these components may also be used in combination.

On the other hand, the following polycondensation products may each be mentioned as the water-soluble polymer compound, i.e., the component (B). Among such polycondensation products, those having molecular weights in the range of from 1,000 to 10,000,000 are preferred.

The following compounds may thus be mentioned as specific examples of the monomer for the component (B):

(a) 3-methacryloxy-2-hydroxypropyldimethylamine, 3-methacryloxy-2-hydroxypropylethylmethylamine, 3-methacryloxy-2-hydroxypropyldiethylamine, 3-methacryloxy-2-hydroxypropyldipropylamine, etc., all of which are represented by Formula (I); N,N-dimethylamino-methylene-capped ethyleneglycol methacrylate, N,N-dimethylaminoethylene-capped ethyleneglycol col methacrylate, N,N-dimethylaminopropylene-capped ethyleneglycol methacrylate, N,N-dimethylaminomethylene-capped diethyleneglycol methacrylate, N,N-dimethylamino-ethylene-capped diethyleneglycol methacrylate, N,N-dimethyl-aminopropylene-capped diethyleneglycol methacrylate, N,N-diethylaminomethylene-capped ethyleneglycol methacrylate, N,N-diethylaminoethylene-capped ethyleneglycol methacrylate, N,N-diethylaminopropylene-capped ethyleneglycol methacrylate, N,N-diethylaminomethylene-capped diethylene-glycol methacrylate, N,N-diethylaminoethylene-capped diethyleneglycol methacrylate, N,N-diethylaminopropylene-capped diethyleneglycol methacrylate, etc., all of which are represented by Formula (II); N-2-hydroxymethyl-2-α-methylvinylimidazole, N-2-hydroxyethyl-2-α-methylvinylimidazole, N-2-hydroxypropyl 2-α-methylvinylimidazole, etc., all of which are represented by Formula (III); N,N-dimethylmethyleneiminemethacrylic amide, N,N-dimethyl-ethyleneiminemethacrylic amide, N,N-dimethyldimethyleneiminemethacrylic amide, N,N-dimethyl-diethyleneiminemethacrylic amide, N,N-diethylmethyleneimine-methacrylic amide, N,N-diethylethyleneiminemethacrylic amide, N,N-diethyldimethyleneiminemethacrylic amide, N,N-diethyldiethyleneiminemethacrylic amide, and so on, all of which are represented by Formula (IV); dimethylaminoethyl acrylate, diethylaminoethyl acrylate, dimethylaminoethyl methacrylate, diethylaminoethyl methacrylate, dimethylamino-propylacrylic amide, diethylamino-propylacrylic amide, dimethylaminopropylmethacrylic amide, diethylaminopropylmethacrylic amide and the like, all of which are represented by Formula (V); dimethylaminomethylethylene, diethylamino-methylethylene, dimethylaminomethylpropene, diethylaminomethylpropene and so on, all of which are represented by Formula (VI); vinylpyridine, etc. as compounds represented by Formula (VII); vinylpiperidine, vinyl-N-methylpiperidine, etc. of Formula (VIII); and vinylbenzylamine, vinyl-N,N-dimethylbenzylamine and the like, all of which are represented by Formula (IX).

(b) Copolymers, each of one or more of the nitrogen-containing monomers represented respectively by the general formulae (I) to (IX) or salts thereof and one or more vinyl monomers selected from the group consisting of α,β-unsaturated carboxylic acids and salts and derivatives thereof, sulfo-containing vinyl compounds and salts thereof, acrylonitrile, vinylpyrrolidone, and aliphatic olefins containing 2 to 20 carbon atoms:

As such vinyl monomers, may for example be mentioned vinylpyrrolidone, acrylonitrile, acrylic acid, methacrylic acid and maleic acid, as well as their alkali metal salts, ammonium salts, amide compounds and ester compounds; vinylsulfonic acid, methallylsulfonic acid, 2-acrylamido-2methylpropanesulfonic acid and p-styrenesulfonic acid as well as their alkali metal salts and ammonium salts; etc.

(c) Salts and quaternary ammonium salts of ring-opened polymers of ethyleneimine:

More specifically, their recurring units are each represented by the following general formula (XI) and they have average molecular weights of 1,000 to 10,000,000.

$$-[(CH_2CH_2-NH)_{n^3}(CH_2CH_2-\underset{\underset{CH_2CH_2NH_2}{|}}{N})_{n^4}] \quad \text{(XI)}$$

wherein $n^3$ stands for an integer of 1 to 5, and $n^4$ stands for an integer of 0 to 5.

(d) Salts and quaternary ammonium salts of polycondensation products between aliphatic dicarboxylic acids and polyethylenepolyamine or dipolyoxyalkylamines:

Specifically speaking, there may be mentioned polycondensation products having molecular weights in the range of 1,000 to 10,000,000 and obtained with polyethylene-polyamines the recurring units of which are represented by the general formula (XII) and dipolyoxyethylenealkylamines the recurring units of which are represented by the general formula (XIII):

$$+OC-R_7-CONH(R'-NH)_{n^5}R'-NH+ \quad \text{(XII)}$$

wherein $R_7$ means a residual group of a dimeric acid or an alkylene group having 1 to 10 carbon atoms, R' denotes $-CH_2CH_2-$, and $n^5$ stands for an integer of 2 to 7: and $$+OC-R_7-CO(OCH_2\overset{\overset{R_9}{|}}{CH})_{n^6}-N(\overset{\overset{R_8}{|}}{C}H\overset{\overset{R^9}{|}}{C}HCH_2O)_{n^7}+ \quad \text{(XIII)}$$

wherein $R_9$ is the same as that defined in Formula (XII), $R_8$ denotes an alkyl group having 1 to 8 carbon atoms, $R_9$ is H or $CH_3$, and $n^6$ and $n^7$ stand individually for an integer of 1 to 10.

As the above-described dicarboxylic acids, may be mentioned dimeric acids, adipic acid and the like. On the other hand, it is possible to use diethylenetriamine, triethylenetetramine or the like as the polyethylenepolyamine.

(e) Dihaloalkane-polyalkylenepolyamine polycondensation products:

More specifically, they are polycondensation products, namely, the quaternary ammonium salts formed between dihaloalkanes such as 1,2-dichloroethane, 1,2-dibromoethane, 1,3-dichloropropane and the like and polyalkylenepolyamines, each of which contains two or more tertiary amino groups in its molecule, and having average molecular weights of 1,000 to 10,000,000.

As the above-described polyalkylenepolyamines, the following compounds may be mentioned:

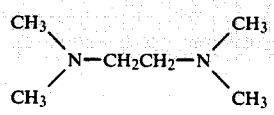

(tetramethylethylenediamine)

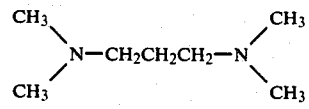

(tetramethylpropylenediamine)

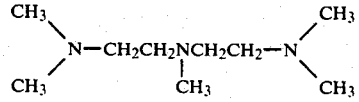

(pentamethyldiethylenetriamine)

-continued

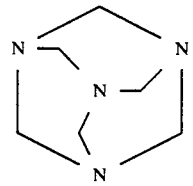

(hexamethylenetetramine)

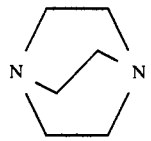

(triethylenediamine)

(f) Ephihalohydrin-amine condensation products:

Specifically speaking, may be mentioned those having average molecular weights of 1,000 to 10,000,000 and containing recurring units represented by the following general formula (XIV):

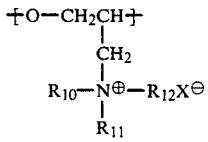

(XIV)

wherein $R_{10}$ to $R_{12}$ are individually $CH_3$ or $C_2H_5$, and $X^{\ominus}$ *denotes a halogen ion.*

(g) Salts of chitosan, and cation-modified products of starch and cellulose.

(h) Polyetherpolyols and polyolpolyether derivatives obtained respectively by adding alkylene oxides to polyalkyleneimines having 6 to 200 nitrogen atoms or derivatives thereof and having molecular weights of 1,000 to 600,000.

The polyalkylenepolyamines are polyethyleneimines each of which continuously contains, in its molecule, at least five moieties represented individually by the following formula (XV):

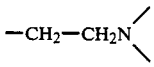

(XV)

at least one of said five moieties being a moiety represented by the following formula (XVI):

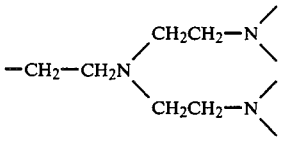

(XVI)

and has OH and/or $NH_2$ groups at least one end thereof, and contains 6 to 100 nitrogen atoms.

It is preferred that the alkylene oxide in the polyetherpolyol is one or more oxides selected from the group consisting of ethylene oxide, propylene oxide, styrene oxide and butylene oxide and the content of the alkylene oxide is 3 to 80 wt% of the polyetherpolyol.

It is more preferred that the above described polycondensation products (a) to (h) have average molecular weights of 1,000 to 1,000,000.

In addition, the following surfactants (1) to (16) may be mentioned as examples of the surfactant, i.e., the component (C):

(1) Polyoxyethylenealkyl and alkylaryl ethers, each having 6 to 22 carbon atoms, and the end-carboxymethylated salts thereof;

(2) Polyoxyethylenepolyoxypropylenealkyl and alkylaryl ethers, each having 6 to 22 carbon atoms;

(3) Oxyethylene-oxypropylene block polymers;

(4) The sorbitan and polyoxyethylenesorbitan esters of fatty acids having 10 to 18 carbon atoms;

(5) Polyethylene glycol esters containing 10 to 18 carbon atoms;

(6) Monofatty acid-glycerin esters having 10 to 18 carbon atoms;

(7) Polyoxyethylenealkylamines containing 6 to 22 carbon atoms;

(8) Salts of alkyl- and alkylaryl-sulfonic acids containing 6 to 22 carbon atoms;

(9) Salts of alkyl- and alkylaryl-sulfuric acids containing 6 to 22 carbon atoms;

(10) Salts of condensation products of naphthalenesulfonic acid and formaladehyde and their derivatives;

(11) Salts of alkyl- and alkylaryl-phosphonic acids or alkyl- and alkylaryl-phosphinic acids, each containing 6 to 22 carbon atoms;

(12) Salts of sulfates of polyoxyethylenealkyl- and polyoxyethylenealkylaryl ethers containing 6 to 22 carbon atoms;

(13) Salts of fatty acids containing 6 to 22 carbon atoms;

(14) Alkylaminecarbonates containing 6 to 22 carbon atoms;

(15) Alkyl- and Alkylarylammonium salts containing 6 to 22 carbon atoms, and their derivatives; and

(16) Ethyleneoxide and propyleneoxide addition products of ethylenediaminetetraacetic acid.

As examples of the extreme-pressure additive of the component (D), the following compounds (i) to (x) are mentioned:

(i) phosphoric acid and phosphorous acid as well as thio compounds and ester compounds thereof;

(ii) mono- and di-phosphoric acid esters containing respectively alkyl, alkylaryl and aryl groups which contain individually at least one hydroxyl group as well as thio compounds thereof;

(iii) mono- or di-phosphonic acids which contain respectively alkyl groups containing 1 to 8 carbon atoms, alkylaryl groups and aryl group and thio compounds thereof, as well as derivatives thereof;

(iv) mono- ordi-phosphinic acids which contain respectively alkyl groups having 1 to 8 carbon atoms, alkylaryl groups and aryl group and thio compounds thereof, as well as derivatives thereof; and (v) mono-, di- and tri-phosphonic acids containing one or more nitogen atoms.

(vi) thioalcohols containig alkyl groups having 1 to 8 carbon atoms or aryl group;

(vii) thiocarboxylic acids containing alkyl groups having 1 to 10 carbon atoms, hydroxyalkyl groups, alkylaryl groups or hydroxyalkylaryl groups, and salts thereof;

(viii) organozinc compounds;

(ix) $R_o—(S)_z—R_o$ wherein z stand for an integer of 1 to 5, and $R_o$ has the same meaning as that defined in the compounds (iii); and (x) organic sulfur-containing heterocyclic compounds, and salts and derivatives thereof.

Among these extreme-pressure additives, the following compounds may be mentioned as specific examples of the compounds (i) to (v):

As phosphoric acid compounds (i), may be mentioned by way of example phosphoric acid, phosphorous acid, mono- or di-phosphoric acid esters between aliphatic alcohols containing 1 to 8 carbon atoms, alicyclic alcohols or aromatic alcohols and phosphoric acid as well as thio compounds of the mono- or di-phosphoric acid esters, and esters between the above alcohols and phosphorous acid and thio compounds of the esters. As an exemplary phosphoric acid ester compound (ii), may be mentioned 2-hydroxydipropyl phosphate. Illustrative of the phosphoric acid compounds (iii) may include phosphonic acids represented by the general formula:

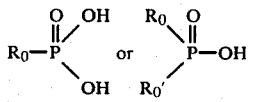

wherein $R_0'$ and individually an alkyl group having 1 to 8 carbon atoms, alkylaryl group or aryl group, for example, methylphosphonic acid and dimethylphosphonic acid containing 1 carbon atom to n-octylphosphonic acid and di-n-octylphosphonic acid containing 8 carbon atoms; 2-ethylhexylphosphonic acid, di-2-ethylhexylphosphonic acid, benzylphosphonic acid, dibenzylphosphonic acid, phenylphosphonic acid, diphenylphosphonic acid and hydroxyethanediphosphonic acid, as well as their thiophosphonic acids. Hydroxyethanediphosphonic compound is a compound represented by the following formula:

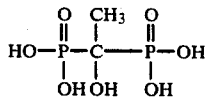

As exemplary phosphoric acid compounds (iv), may be mentioned phosphinic acids represented by the general formula:

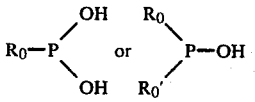

wherein $R_0$ and $R_0'$ have the same meanings as defined above, for example, methylphosphinic acid and dimethylphosphinic acid containing 1 carbon atom to n-octylphosphinic acid and di-n-octylphosphinic acid containing 8 carbon atoms; 2-ethylhexylphosphinic acid, di-2-ethylhexylphosphinic acid, benzylphosphinic acid, dibenzylphosphinic acid, phenylphosphinic acid and dipehylphosphinic acid, as well as their thiophosphinic acids. As phosphoric acid compounds (v), may for example be mentioned hexamethylphosphoric mono-(or di-)amide and nitrilotrismethylenephosphonic acid. Nitrilotrismethylenephosphonic acid is a compound represented by the following formula:

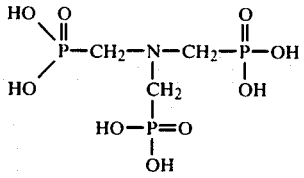

The metal-working oil composition of this invention may be prepared by mixing the above components. It is however preferred to limit, in the one aspect of this invention, their proportions within the following ranges, all based on the whole composition: the lube-oil component (a): 99.8 to 50 wt% (hereinafter referred to merely as %), especially 99.8 to 70%, the water-soluble polymer compound (b): 0.1 to 10%, especially 0.1 to 5%, and the surfactant (c): 0.1 to 10%, especially 0.1 to 5%. It is also preferred to make the total proportion of the components (b) and (c) be 0.1 to 10% of the whole composition.

In another aspect of this invention, it is preferred to limit the proportions of the components (a), (b), (c) and (d) to the following ranges: the component (a): 99.7 to 50%, especially 99.7 to 70%, the component (b): 0.1 to 20%, especially 0.1 to 10%, the component (c): 0.1 to 5%, especially 0.1 to 3%, and the component (d), i.e., the extreme-pressure additive: 0.1 to 10%, especially 0.1 to 5%.

To the metal-working oil composition of this invention, it is feasible to add, besides the above-mentioned components, a variety of known additives as needed, for example, a surfactant, rust preventive, oilness agent, extreme-pressure additive, antioxidant and the like.

The above-described various additives may, whenever necessary, be added respectively in amounts of 0 to 2%, 0 to 20% and 0 to 5%.

As illustrative rust preventives, may be mentioned fatty acids such as alkenylsuccinic acids and their derivatives and oleic acid, esters such as sorbitan monooleate, and amines, and so on. Exemplary oilness agents may include higher fatty acids such as oleic acid and stearic acid, fatty acid esters which are derivatives of such fatty acids, dibasic acids such as dimeric acid and the like. As illustrative antioxidants, may be mentioned phenolic compounds such as 2,4-di-t-butyl-p-cresol, aromatic amines such as phenyl-alpha-naphthylamine, etc.

The metal-working oil composition of this invention may be employed by either simply mixing the above-described various components upon actually using the metal-working oil composition or preparing it as a thick solution having a water content of up to about 80% in advance and then diluting same with water upon actually using the metal-working oil composition.

The thus-obtained metal working oil composition according to this invention can provide a metal-working oil which is stable under such stirring conditions as having a high shear force, can afford uniform droplet size distribution, exhibits high lubricity and undergoes only a small degree of quality change along the passage of time small quality changes along the passage of time. Besides, the above metal-working oil composition of this invention has such merits as will be described next. Both of the water-soluble polymer compound and surfactant, which are useful in the practice of this invention, have such capacity as being rapidly adsorbed on liquid or solid particles to make the liquid or solid particles hydrophilic. Compared with conventional metal-working oils making use of emulsifiers, the metal-working oil composition of this invention is thus advantageous, owing to the action of both of the water-soluble polymer compound and surfactant, in that it develops the so-called holding-in phenomenon, that is to absorb fouled oil mixed in during an actual rolling operation and foreign matter such as metal powder and the like, only to a lowered extent and it always retain high lubricating characteristics as a clean metal-working oil. Owing to the functions of both of the above-described water-soluble polymer compound and surfactant, the metal-working oil composition of this invention improves the fouling of working environments and is excellent in the easiness in treating resulting waste water. Therefore, the metal-working oil composition of this invention has such an excellent feature that it can materialize a clean working environment which has not been achieved by any conventional rolling mill oils making use of emulsifiers.

Further, it is to be noted that, metal-working oil compositions desirably satisfy the performance requirements of rapid rising of concentration of the composition to a predetermined value at the time of oil bathing or oil supply, and readiness in controlling the concentration of the composition by a stirring force. The invention products (metal-working oil) make the lubricant component rapidly and stably dispersed in water owing to the action of the surfactant component, thus satisfy a requisite of above-mentioned concentration-enhancing property. Moreover, since the water-soluble polymer compounds according to the invention coagulate (but not agglomorate) the oil particles under the condition not more than a certain shear force (stirring force), as a result, to expedite the lubricant component to float up to the surface, consequently concentrations in the bottom part in oil tank can be rapidly varied, and thus the invention products have a superior concentration control property.

Although the mechanism of action achieved owing to the use of the water-soluble polymer compound and surfactant and the combined use of the extreme-pressure additive with the compound and surfactant in accordance with this invention has not been fully elucidated, they seem to act probably in the following manner. Namely, the water-soluble polymer compound dissolved uniformly in the water layer and/or the surfactant dissolved in water adborb promptly droplets of the lube-oil component, which droplets have been formed by mechanical shear forces, before the droplets begin to agglomerate. As a result, strong adsorptive films are formed based on the own strong adsorbancy of each of water-soluble polymer compound and surfactant to oil droplets, the affinity of the water-soluble polymer compound to hydrophilic groups of the surfactant. The lube-oil component is formed into uniform and stable droplets in accordance with a sort of coagulation action induced by the cooperation of both of the polymer compound and surfactant. The resultant larger droplets are dispersed stably in water by the steric and electric, protective-colloidal action brought about by the cooperation of both of the polymer compound and surfactant.

Owing to the strong protective action of both of the water-soluble polymer compound and surfactant to the surfaces of droplets, it is possible to avoid mixing of metal powder, scum and the like, which are formed in the course of each working operation, into the oil. Therefore, the working-oil composition may always be kept as a clean working oil, whereby making it possible to make the surface of each workpiece cleaner. It is thus assumed that the action of the extreme-pressure additive, which forms a lubricating film on each metal surface to enhance the lubricity, can be exhibited more effectively in a lubricating state while the metals are kept in mutual contact upon working the workpiece.

The present invention will hereinafter be described with reference to Examples.

The formulations of metal-working oil compositions used in the Examples are given in Tables 1—1 to 1-6. The following materials were used respectively as water-soluble polymer compounds, an antioxidant, extreme-pressure additives and surfactants:

Water-soluble polymer compounds:

(A) The phosphoric acid salt of a polymer of diethylaminomethylmethacrylate (MW=10,000);

(B-1) A 5:4:1 (by molar ratio. All designations of ratio will hereinafter mean molar ratios in this table) copolymer of the boric acid salt of diethylaminoethyl methacrylate, vinylpyrrolidone and sodium acrylate (MW =200,000);

(B-2) ditto (MW=50,000);

(B-3) ditto (MW=5,000);

(B-4) ditto (MW=1,500);

(C) A 4:5 copolymer of the phosphoric acid salt of diethylaminoethyl methacrylate and sodium methacrylate (MW=20,000);

(D-1) A ring-opened polymer of the phosphoric acid salt of ethyleneimine (MW=100,000);

(D-2) A water-soluble polymer compound obtained by reacting propionic acid to polyethyleneimine (MW=70,000) in such amounts that the propionic acid is 15 wt% of the polyethyleneimine and then converting the reaction product into its boric acid salt;

(D-3) A water-soluble polymer compound obtained by reacting stearyl isocyanate to polyethyleneimine (MW=10,000) in such amounts that the stearyl isocyanate is 5 wt% of the polyethyleneimine and then converting the reaction product into its phosphoric acid salt;

(E) A 3:1 copolymer of the ethylphosphinous acid salt of dimethylaminoethyl methacrylate and sodium acrylate (MW=300,000);

(F) A 4:1 copolymer of the ethylphosphonic acid salt of dimethylaminoethyl methacrylate and sodium 2-acrylamino-2-methylpropanesulfonate (MW=100,000);

(G) A 6:3:1 copolymer of the phosphoric acid salt of vinylpyridine, vinylpyrrolidone and sodium acryalte (MW=450,000);

(H) A polycondensation product between the thiophosphoric acid salt of diethylenetriamine and dimeric acid (MW=800,000);

(I) A 3:1:1 copolymer of the phosphoric acid salt of diethylaminoethylmethacrylamide, sodium acrylate and sodium vinylsulfonate (MW=400,000);

(J) A 6:3:1 copolymer of the quaternary ammonium salt of vinylpyridine by dimethylphosphinic acid, vinylphyrrolidone and sodium acrylate (MW=450,000);

(K) A water-soluble polymer compound obtained by converting the phosphoric acid salt of diethylaminoethylmethacrylamide in the water-soluble polymer compound (I), into its boric acid salt;

(L) The quaternary ammonium salt of a cation-modified product of cellulose (MW=1,000,000);

(M) A polycondensation product between 1,2-dichloroethane and the phosphoric acid salt of hexamethylenetetramine (MW=50,000);

(N) A polycondensation product between the ethylphosphinic acid salt of diethylenetriamine and dimeric acid (MW=800,000);

(O) A ring-opened polymer of the phosphorous acid salt of the trimethylamine quaternary ammonium compound of epichlorohydrin (MW=100,000);

(P) A polycondensation product of the quaternary ammonium salt of tetramethylpropylenediamine by diethylphosphonic acid (MW=100,000);

(Q) A water-soluble polymer compound obtained by converting the phosphoric acid salt of vinylpyridine in the water-soluble polymer compound (G), into its sulfuric acid salt;

(R) A water-soluble polymer compound obtained by converting the thiophosphoric acid salt of diethylenetriamine in the water-soluble polymer compound (H), into its nitric acid salt;

(S) A water-soluble polymer compound obtained by converting the ethylphosphonic acid salt of dimethylaminoethyl methacrylate in the water-soluble polymer compound (F), into its hydrochloric acid salt;

(T) A water-soluble polymer compound obtained by converting the ethylphosphinous acid salt of dimethylaminoethyl methacrylate in the water-soluble polymer compound (E), into its glycolic acid salt;

(U) A water-soluble polymer compound obtained by converting the phosphoric acid salt of ethyleneimine in the water-soluble polymer compound (D), into its acetic acid salt;

(V) A 6:3:1 copolymer of the quaternary ammonium salt of vinylpyridine by dimethylsulfuric acid, vinylpyrrolidone and sodium acrylate (MW=450,000);

(W) A 20% ethylene oxide addition product of polyethyleneimine (MW=50,000);

(X) A 10:3:3 addition product of polyethyleneimine, ethylene oxide and propylene oxide (MW=150,000);

(Y) The Na salt of homopolymer of N-1-dimethylsulfoethylacrylamide (MW=70,000);

(Z) A 1:1 copolymer of the Na salt of N-1-dimethylsulfoethylacrylamide and the phosphoric acid salt of dimethylaminoethyl methacrylate (MW=20,000);

(AA) A 1:1 copolymer of the phosphonic acid salt of ethyleneimine and the ethylphosphinic acid salt of dimethylaminoethyl methacrylate (MW=60,000);

(BB) A 2:1 copolymer of the phosphoric acid salt of 3-methacryloxy-2-hydroxypropyltrimethyl ammonium and the ethylphosphinic acid salt of dimethylaminoethyl methacrylate (MW=50,000);

(CC) A 1:1 copolymer of the phosphonic acid salt of methacryl dimethylaminoethyl ethoxylate and ethyleneimine (MW=80,000);

(DD) Phosphoric acid salt of a polymer of nitrogen-containing monomer* (I) (MW=10,000);

(EE) A 4:5 copolymer of phosphoric acid salt of nitrogen-containing monomer* (II) and sodium methacrylate (MW=20,000);

(FF) A 6:3:1 copolymer of phosphoric acid salt of nitrogen-containing monomer* (III), vinylpyrrolidone and sodium laurylmethacrylate (MW=450,000);

(GG) Polycondensation product of thiophosphoric acid salt of nitrogen-containing monomer (IV) and a dimeric acid (MW=800,000);

(HH) A 3:1:1 copolymer of phosphoric acid salt of nitrigen-containing monomer* (V), sodium acrylate and sodium vinylsulfonate (MW=400,000);

(II) A 6:3:1 copolymer of quaternary ammonium salt of nitrigen-containing monomer* (VI) by dimethylphosphinic acid, vinylpyrrolidone and sodium acrylate (MW=450,000);

(JJ) Water-soluble polymer compound obtained by converting the phosphoric acid salt of nitrogen-containing monomer (V) in water-soluble polymer compound (HH) into its boric acid salt;

(KK) Water-soluble polymer compound obtained by converting the phosphoric acid salt of nitrogen-containing monomer (III) in water-soluble polymer compound (FF) into its sulfuric acid salt;

(LL) Water-soluble polymer compound obtained by converting the thiophosphoric acid salt of nitrogen-containing monomer (IV) in water-soluble polymer compound (GG) into its nitric acid salt; Note: Nitrogen-containing monomers (indicated by "*") respectively means as follows.

Nitrogen-containing monomer (I):

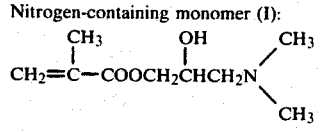

Nitrogen-containing monomer (II):

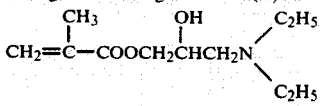

Nitrogen-containing monomer (III):

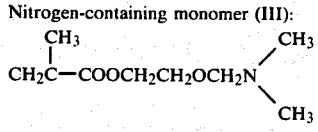

Nitrogen-containing monomer (IV):

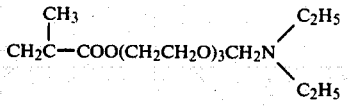

Nitrogen-containing monomer (V):

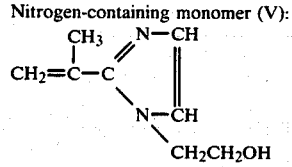

Nitrogen-containing monomer:

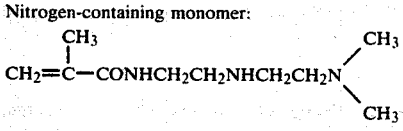

Surfactants:

(1) Polyoxyethylenenonyl phenyl ether (HLB=10.6);

(2) Polyoxyethylenesorbitan monostrearate (5 moles EO addition product);

(3) Polyoxyethylenelaurylamine (6 moles EO addition product);

(4) Polyoxyethylenesorbitan trioleate; and (5) Glycerin monooleate.

Extreme-pressure additives:

(1) Triphenyl phosphate;

(2) The Mg salt of butylthiophosphonic acid; and (3) The amine salt of zinc dithioethylphosphate.

Antioxidant:

2,4-di-t-butyl-p-cresol.

TABLE 1

(%)

| Invention Product | Lube-Oil Component: Beef Tallow | Lube-Oil Component: Fatty Acids Derived from Beef Tallow | Water-Soluble, High Molecular Compound | | Surfactant | Anti-Oxidant |
|---|---|---|---|---|---|---|
| No. 1 | 95.5 | 2 | (A) | 0.5 | (1) 1 | 1 |
| No. 2 | 95.5 | 2 | (B-1) | 0.5 | (2) 1 | 1 |
| No. 3 | 95.5 | 2 | (B-2) | 0.5 | (3) 1 | 1 |
| No. 4 | 95.5 | 2 | (B-3) | 0.5 | (1) 1 | 1 |
| No. 5 | 94 | 2 | (C) | 2 | (3) 1 | 1 |
| No. 6 | 91.5 | 2 | (D-1) | 5 | (1) 0.5 | 1 |
| No. 7 | 92 | 2 | (E) | 2 | (2) 2 | 1 |
| | | | (F) | 1 | | |
| No. 8 | 93.8 | 2 | (G) | 0.2 | (3) 3 | 1 |
| No. 9 | 95.6 | 2 | (H) | 0.2 | (1) 1 | 1 |
| | | | (I) | 0.2 | | |
| No. 10 | 92 | 2 | (J) | 1 | (2) 1 | 1 |
| | | | (K) | 3 | | |
| No. 11 | 94.5 | 2 | (L) | 2 | (3) 0.5 | 1 |
| No. 12 | 88 | 2 | (M) | 5 | (1) 2 | 1 |
| | | | (N) | 2 | | |
| No. 13 | 94.8 | 2 | (O) | 1 | (2) 0.2 | 1 |
| | | | (P) | 1 | | |
| No. 14 | 96.3 | 2 | (Q) | 0.5 | (3) 0.2 | 1 |
| No. 15 | 93 | 2 | (R) | 2 | (1) 1 | 1 |
| | | | (S) | 1 | | |
| No. 16 | 96 | 2 | (DD) | 0.5 | (1) 0.5 | 1 |
| No. 17 | 94.5 | 2 | (EE) | 2 | (3) 0.5 | 1 |
| No. 18 | 96.7 | 2 | (FF) | 0.2 | (3) 0.1 | 1 |
| No. 19 | 95.6 | 2 | (GG) | 0.2 | (1) 1 | 1 |
| | | | (HH) | 0.2 | | 1 |
| No. 20 | 92 | 2 | (II) | 1 | (2) 1 | 1 |
| | | | (JJ) | 3 | | |
| No. 21 | 96.3 | 2 | (KK) | 0.5 | (3) 0.2 | 1 |
| No. 22 | 93 | 2 | (LL) | 2 | (1) 1 | 1 |
| | | | (S) | 1 | | |

(%)

| Invention Product | Lube-Oil Component: Mineral Oil (Spindle Oil) | Lube-Oil Component: Octyl Stearate | Lube-Oil Component: Oleic Acid | Water-Soluble, High Molecular Component | | Surfactant | Anti-Oxidant |
|---|---|---|---|---|---|---|---|
| No. 23 | 71.5 | 20 | 5 | (S) | 2 | (2) 0.5 | 1 |
| No. 24 | 72 | 20 | 5 | (T) | 1 | (3) 1 | 1 |
| No. 25 | 67 | 20 | 5 | (U) | 5 | (1) 2 | 1 |
| No. 26 | 71.7 | 20 | 5 | (V) | 0.3 | (2) 2 | 1 |
| No. 27 | 72.5 | 20 | 5 | (W) | 0.5 | (3) 1 | 1 |
| No. 28 | 71.8 | 20 | 5 | (X) | 2 | (1) 0.2 | 1 |
| No. 29 | 72.5 | 20 | 5 | (Y) | 1 | (2) 0.5 | 1 |
| No. 30 | 72.5 | 20 | 5 | (Z) | 1 | (3) 0.5 | 1 |

(%)

| Invention Product | Lube-Oil Component: Mineral Oil (Cylinder Oil) | Lube-Oil Component: Pentaerythritol Tetraoleate | Water-Soluble, High Molecular Compound | | Surfactant | Anti-oxidant |
|---|---|---|---|---|---|---|
| No. 31 | 78 | 20 | (AA) | 0.5 | (1) 0.5 | 1 |
| No. 32 | 76 | 20 | (BB) | 2 | (2) 1 | 1 |
| No. 33 | 75 | 20 | (CC) | 1 | (3) 3 | 1 |
| No. 34 | 72 | 20 | (C) | 5 | (1) 2 | 1 |
| No. 35 | 77.8 | 20 | (D-1) | 0.2 | (2) 1 | 1 |
| No. 36 | 77.5 | 20 | (G) | 0.5 | (3) 1 | 1 |
| No. 37 | 76.5 | 20 | (L) | 2 | (1) 0.5 | 1 |
| No. 38 | 73.8 | 20 | (V) | 1 | (2) 0.2 | 1 |
| | | | (T) | 4 | | |
| No. 39 | 73.5 | 20 | (EE) | 5 | (1) 0.5 | 1 |
| No. 40 | 78.3 | 20 | (FF) | 0.5 | (3) 0.2 | 1 |

(%)

| Invention Product | Lube-Oil Component: Beef Tallow | Lube-Oil Component: Fatty Acids Derived from Beef Tallow | Water-Soluble, High Molecular Compound | | Extreme-Pressure Additive | Surfactant | Anti-oxidant |
|---|---|---|---|---|---|---|---|
| No. 41 | 94 | 2 | (B-1) | 1 | (3) 1 | (1) 1 | 1 |
| No. 42 | 93.5 | 2 | (B-2) | 1 | (1) 0.5 | (4) 2 | 1 |
| No. 43 | 94 | 2 | (B-3) | 1 | (2) 1 | (5) 1 | 1 |
| No. 44 | 92 | 2 | (B-4) | 1 | (2) 2 | (4) 2 | 1 |
| No. 45 | 94 | 3 | (D-2) | 1 | (1) 1 | (5) 1 | 1 |
| No. 46 | 89 | 2 | (D-1) | 1 | (3) 3 | (1) 3 | 1 |
| | | | (E) | 1 | | | |
| No. 47 | 93.5 | 2 | (F) | 0.5 | (2) 0.5 | (5) 1 | 1 |
| | | | (G) | 0.5 | | | |
| No. 48 | 90 | 2 | (H) | 2 | (1) 1 | (4) 2 | 1 |
| | | | (I) | 2 | | | |

TABLE 1-continued

| | | | | | | | |
|---|---|---|---|---|---|---|---|
| No. 49 | 88 | 2 | (J) | 5 | (1) 3 | (4) 1 | 1 |
| No. 50 | 92.95 | 2 | (K) | 0.05 | (2) 1 | (5) 3 | 1 |
| No. 51 | 93 | 2 | (L) | 1 | (3) 2 | (1) 1 | 1 |
| No. 52 | 93.5 | 2 | (M) | 2 | (2) 1 | (5) 0.5 | 1 |
| No. 53 | 95.7 | 2 | (N) | 0.2 | (3) 0.5 | (1) 0.5 | 1 |
| | | | (O) | 0.1 | | | |
| No. 54 | 93.5 | 2 | (P) | 0.5 | (1) 2 | (4) 1 | 1 |
| No. 55 | 94.5 | 2 | (Q) | 0.5 | (2) 1 | (5) 1 | 1 |
| No. 56 | 93 | 2 | (R) | 2 | (3) 1 | (4) 1 | 1 |
| No. 57 | 95 | 2 | (F) | 0.5 | (2) 0.5 | (5) 0.5 | 1 |
| | | | (FF) | 0.5 | | | |
| No. 58 | 91.5 | 2 | (GG) | 2 | (1) 1 | (4) 0.5 | 1 |
| | | | (HH) | 2 | | | |
| No. 59 | 88 | 2 | (II) | 5 | (1) 3 | (4) 1 | 1 |
| No. 60 | 92.95 | 2 | (JJ) | 0.05 | (2) 3 | (5) 1 | 1 |
| No. 61 | 94.5 | 2 | (KK) | 0.5 | (2) 1 | (5) 1 | 1 |
| No. 62 | 93 | 2 | (LL) | 2 | (3) 1 | (4) 1 | 1 |

(%)

| Invention Product | Lube-Oil Component: Mineral Oil (Cylinder Oil) | Lube-Oil Component: Pentaerythritol Tetraoleate | Water-Soluble, High Molecular Compound | | Extreme-Pressure Additive | Surfactant | Anti-Oxidant |
|---|---|---|---|---|---|---|---|
| No. 63 | 76.5 | 20 | (S) | 0.5 | (2) 1 | (1) 1 | 1 |
| No. 64 | 74.5 | 20 | (T) | 1 | (3) 2 | (5) 0.5 | 1 |
| | | | (U) | 1 | | | |
| No. 65 | 74 | 20 | (V) | 3 | (3) 1 | (4) 1 | 1 |
| No. 66 | 74.5 | 20 | (W) | 2 | (1) 2 | (5) 0.5 | 1 |
| No. 67 | 74.5 | 20 | (X) | 0.3 | (3) 3 | (1) 1 | 1 |
| | | | (Y) | 0.2 | | | |
| No. 68 | 71 | 20 | (Z) | 5 | (2) 1 | (4) 2 | 1 |
| No. 69 | 74.5 | 20 | (AA) | 0.5 | (3) 1 | (4) 2 | 1 |
| | | | (BB) | 1 | | | |
| No. 70 | 75.95 | 20 | (CC) | 0.05 | (1) 2 | (1) 1 | 1 |
| No. 71 | 76.5 | 20 | (U) | 0.5 | (2) 1 | (5) 1 | 1 |
| No. 72 | 73.5 | 20 | (B-3) | 3 | (2) 2 | (5) 0.5 | 1 |
| No. 73 | 71 | 20 | (C) | 5 | (3) 2 | (1) 1 | 1 |
| No. 74 | 75.5 | 20 | (E) | 1 | (2) 1 | (4) 0.5 | 1 |
| | | | (F) | 1 | | | |
| No. 75 | 77 | 20 | (G) | 0.5 | (3) 0.5 | (1) 1 | 1 |
| No. 76 | 71 | 20 | (EE) | 5 | (3) 2 | (1) 1 | 1 |
| No. 77 | 77 | 20 | (FF) | 0.5 | (3) 0.5 | (1) 1 | 1 |

(%)

| Invention Product | Lube-Oil Component: Mineral Oil (Spindle Oil) | Lube-Oil Component: Octyl Stearate | Lube-Oil Component: Oleic Acid | Water-Soluble High Molecular Compound | | Extreme-Pressure Additive | Surfactant | Anti-Oxidant |
|---|---|---|---|---|---|---|---|---|
| No. 78 | 71.6 | 20 | 5 | (H) | 0.2 | (2) 1 | (1) 1 | 1 |
| | | | | (I) | 0.2 | | | |
| No. 79 | 72.5 | 20 | 5 | (J) | 0.5 | (2) 0.5 | (5) 0.5 | 1 |
| No. 80 | 70.5 | 20 | 5 | (K) | 1 | (1) 0.5 | (5) 2 | 1 |
| No. 81 | 67 | 20 | 5 | (M) | 2 | (4) 2 | (4) 3 | 1 |
| No. 82 | 66 | 20 | 5 | (N) | 3 | (1) 1 | (1) 2 | 1 |
| | | | | (O) | 2 | | | |
| No. 83 | 69 | 20 | 5 | (P) | 1 | (1) 3 | (5) 1 | 1 |
| No. 84 | 70.6 | 20 | 5 | (Q) | 0.2 | (1) 1 | (4) 2 | 1 |
| | | | | (R) | 0.2 | | | |
| No. 85 | 69 | 20 | 5 | (S) | 1 | (1) 2 | (4) 1 | 1 |
| | | | | (U) | 1 | | | |
| No. 86 | 72.1 | 20 | 5 | (GG) | 0.2 | (2) 1 | (1) 0.5 | 1 |
| | | | | (HH) | 0.2 | | | |
| No. 87 | 72.5 | 20 | 5 | (II) | 0.5 | (2) 0.5 | (5) 0.5 | 1 |
| No. 88 | 72.3 | 20 | 5 | (JJ) | 1 | (1) 0.5 | (5) 0.2 | 1 |
| No. 89 | 72.4 | 20 | 5 | (KK) | 0.2 | (1) 1 | (4) 0.2 | 1 |
| | | | | (LL) | 0.2 | | | |

Comparative Product No. 1:

Lube-oil component:

| | |
|---|---|
| Beef tallow | 95% |
| Fatty acids derived from beef tallow | 2 |
| Surfactant (1) | 2 |
| Antioxidant | 1 |

Comparative Product No. 2:

Lube-oil component:

| | |
|---|---|
| Mineral oil (cylinder oil) | 77% |
| Pentaerythritol tetraoleate | 20 |
| Surfactant | 2 |
| Antioxidant | 1 |

-continued

Comparative Product No. 3:

Lube-oil component:

| | |
|---|---|
| Mineral oil (spindle oil) | 72% |
| Octyl stearate | 20 |
| Oleic acid | 5 |
| Surfactant (3) | 2 |
| Antioxidant | 1 |

Comparative Product No. 4:

Lube-oil component:

| | |
|---|---|
| Beef tallow | 94% |
| Fatty acids derived from beef tallow | 2 |
| Extreme-pressure additive(1) | 1 |
| Surfactant (2) | 2 |

-continued

| | |
|---|---|
| Antioxidant | 1 |
| Comparative Product No. 5: | |
| Lube-oil component: | |
| Beef tallow | 94% |
| Fatty acids derived from beef tallow | 2 |
| Extreme-pressure additive (2) | 1 |
| Surfactant (2) | 2 |
| Antioxidant | 1 |
| Comparative Product No. 6 | |
| Lube-oil component: | |
| Mineral oil (cylinder oil) | 76% |
| Pentaerythritol tetraoleate | 20 |
| Extreme-pressure additive (1) | 1 |
| Surfactant (4) | 2 |
| Antioxidant | 1 |
| Comparative Product No. 7: | |
| Lube-oil component: | |
| Meneral oil (cylinder oil) | 76% |
| Pentaerythritol, oleate | 20 |
| Extreme-pressure additive (3) | 1 |
| Surfactant (4) | 2 |
| Antioxidant | 1 |
| Comparative Product No. 8: | |
| Lube-oil component: | |
| Mineral oil (spindle oil) | 71% |
| Octyl stearate | 20 |
| Oleic acid | 5 |
| Extreme-pressure additive (1) | 1 |
| Surfactant (1) | 2 |
| Antioxidant | 1 |
| Comparative Product No. 9: | |
| Lube-oil component: | |
| Mineral oil (spindle oil) | 71% |
| Octyl stearate | 20 |
| Oleic acid | 5 |
| Extreme-pressure additive (3) | 1 |
| Surfactant (1) | 2 |
| Antioxidant | 1 |

EXAMPLE 1

Seizure-Resistant Loading Test (Falex Testing Method) The measurement of seizure-resistant loads was carried out in accordance with ASTM Standard D-3233 Pressure Resistant Loading test (Falex Test). The preparation of each test sample was carried out by diluting each metal-working oil composition with water to a concentration of 3% and then mixing the resultant mixture at 10,000 rpm in a homogenizer. The coating of each test sample was effected by applying the above-mixed solution to a rotary pin, which was disposed centrally in a fixed block, at a spray rate of 50 ml/min. (a pressure of 0.5 kg/cm$^2$)and a dispersion temperature of 50° C. by means of a gear pump.

Results are given in Table 2.

TABLE 2

| Metal-working Oil composition | Seizure-resistant Load (lbs.) |
|---|---|
| Invention Product No. | |
| 1 | 2250 |
| 2 | 2000 |
| 3 | 2000 |
| 4 | 2000 |
| 5 | 1750 |
| 6 | 2000 |
| 7 | 2000 |
| 8 | 2000 |
| 9 | 1750 |
| 10 | 2000 |
| 11 | 1500 |
| 12 | 2000 |

TABLE 2-continued

| Metal-working Oil composition | Seizure-resistant Load (lbs.) |
|---|---|
| 13 | 2000 |
| 14 | 1500 |
| 15 | 1500 |
| 16 | 2250 |
| 17 | 1750 |
| 18 | 2000 |
| 19 | 1750 |
| 20 | 2000 |
| 21 | 1500 |
| 22 | 1250 |
| 23 | 1500 |
| 24 | 1500 |
| 25 | 1250 |
| 26 | 1250 |
| 27 | 1750 |
| 28 | 1750 |
| 29 | 1750 |
| 30 | 1750 |
| 31 | 1750 |
| 32 | 1750 |
| 33 | 1500 |
| 34 | 1750 |
| 35 | 1750 |
| 36 | 2000 |
| 37 | 1750 |
| 38 | 1750 |
| 39 | 1750 |
| 40 | 2000 |
| 41 | 1750 |
| 42 | 2000 |
| 43 | 2000 |
| 44 | 2250 |
| 45 | 2000 |
| 46 | 2000 |
| 47 | 2000 |
| 48 | 2000 |
| 49 | 1750 |
| 50 | 1250 |
| 51 | 1750 |
| 52 | 2000 |
| 53 | 2250 |
| 54 | 2250 |
| 55 | 2000 |
| 56 | 2250 |
| 57 | 2000 |
| 58 | 2000 |
| 59 | 1750 |
| 60 | 1250 |
| 61 | 1500 |
| 62 | 1750 |
| 63 | 2000 |
| 64 | 1750 |
| 65 | 1750 |
| 66 | 2000 |
| 67 | 2000 |
| 68 | 2000 |
| 69 | 1750 |
| 70 | 1250 |
| 71 | 1750 |
| 72 | 1750 |
| 73 | 2000 |
| 74 | 2000 |
| 75 | 2000 |
| 76 | 2000 |
| 77 | 2000 |
| 78 | 1750 |
| 79 | 1750 |
| 80 | 2000 |
| 81 | 1750 |
| 82 | 1750 |
| 83 | 1750 |
| 84 | 1750 |
| 85 | 1750 |
| 86 | 1750 |
| 87 | 1750 |
| 88 | 2000 |
| 89 | 1500 |
| Comparative Product No. | |
| 1 | 1250 |

TABLE 2-continued

| Metal-working Oil composition | Seizure-resistant Load (lbs.) |
|---|---|
| 2 | 1000 |
| 3 | 1000 |
| 4 | 1500 |
| 5 | 1250 |
| 6 | 1250 |
| 7 | 1000 |
| 8 | 1000 |
| 9 | 1250 |

EXAMPLE 2

Seizure Loading Test (Soda's four-balls Testing Method)

The measurement of seizure loads was conducted in accordance with Japanese Self-Defence Force Provisional Standard NDS XXK 2740, Oil Film Strength Testing Method (Soda's Four-Ball Testing Method). The preparation of each test sample was carried out by diluting each metal-working oil composition with water to a concentration of 3% and then mixing the resultant mixture at 10,000 rpm in a homogenizer. The coating of each test sample was effected by applying the above-mixed solution upwardly through a gap. formed centrally among three points of contact of three testing steel balls, which were fixed by a ball retainer, to a rotary steel ball, which assumed a position above the three balls, at a spray rate of 0.5 liter/min. (a pressure of 0.5 kg/cm$^2$) and a sample solution temperature of 50° C. by means of a gear pump.

Results are summarized in Table 3.

TABLE 3

| Metal-working Oil Composition | Seizing Load (Kg/cm$^2$) |
|---|---|
| Invention Product No. | |
| 1 | 11.0 |
| 2 | 10.5 |
| 3 | 11.5 |
| 4 | 10.5 |
| 5 | 12.0 |
| 6 | 11.0 |
| 7 | 10.5 |
| 8 | 10.5 |
| 9 | 11.0 |
| 10 | 12.0 |
| 11 | 8.0 |
| 12 | 10.5 |
| 13 | 10.5 |
| 14 | 8.0 |
| 15 | 8.0 |
| 16 | 11.0 |
| 17 | 12.0 |
| 18 | 10.5 |
| 19 | 11.0 |
| 20 | 12.0 |
| 21 | 8.0 |
| 22 | 8.0 |
| 23 | 5.5 |
| 24 | 5.5 |
| 25 | 5.5 |
| 26 | 5.5 |
| 27 | 8.5 |
| 28 | 8.5 |
| 29 | 9.0 |
| 30 | 8.5 |
| 31 | 8.5 |
| 32 | 9.0 |
| 33 | 8.0 |
| 34 | 8.0 |
| 35 | 8.5 |
| 36 | 8.5 |
| 37 | 5.5 |

TABLE 3-continued

| Metal-working Oil Composition | Seizing Load (Kg/cm$^2$) |
|---|---|
| 38 | 8.0 |
| 39 | 8.0 |
| 40 | 8.5 |
| 41 | 12.0 |
| 42 | 12.5 |
| 43 | 11.5 |
| 44 | 11.0 |
| 45 | 10.5 |
| 46 | 11.5 |
| 47 | 11.0 |
| 48 | 12.5 |
| 49 | 11.0 |
| 50 | 7.5 |
| 51 | 12.5 |
| 52 | 12.5 |
| 53 | 11.5 |
| 54 | 11.0 |
| 55 | 12.0 |
| 56 | 11.5 |
| 57 | 11.0 |
| 58 | 12.5 |
| 59 | 11.0 |
| 60 | 7.5 |
| 61 | 9.0 |
| 62 | 9.0 |
| 63 | 10.5 |
| 64 | 8.5 |
| 65 | 9.0 |
| 66 | 9.5 |
| 67 | 10.5 |
| 68 | 9.0 |
| 69 | 8.0 |
| 70 | 6.0 |
| 71 | 8.5 |
| 72 | 9.0 |
| 73 | 8.0 |
| 74 | 8.0 |
| 75 | 8.0 |
| 76 | 8.0 |
| 77 | 8.0 |
| 78 | 8.5 |
| 79 | 9.0 |
| 80 | 9.0 |
| 81 | 9.0 |
| 82 | 8.5 |
| 83 | 8.0 |
| 84 | 8.0 |
| 85 | 8.0 |
| 86 | 8.5 |
| 87 | 9.0 |
| 88 | 9.0 |
| 89 | 7.0 |
| Comparative Product No. | |
| 1 | 7.0 |
| 2 | 5.0 |
| 3 | 5.0 |
| 4 | 7.5 |
| 5 | 7.0 |
| 6 | 6.0 |
| 7 | 6.5 |
| 8 | 6.0 |
| 9 | 6.0 |

EXAMPLE 3

Test on Readiness of Treatment of Waste Water Each test solution (1 liter) prepared in the same manner as in Example 2 was added with 3 g of aluminum sulfate. The resulting mixture was stirred for 2 minutes, followed by an addition of $Ca(OH)_2$ to adjust its pH to 7.0. The thus-prepared mixture was stirred for further 10 minutes. After allowing the resultant mixture to stand for 30 minutes, the supernatant was collected to measure its COD (in accordance with the $KMnO_4$ method).

Results are shown in Table 4.

TABLE 4

| Metal-working Oil Composition | COD (ppm) |
|---|---|
| Invention Product No. | |
| 1 | 889 |
| 2 | 937 |
| 3 | 844 |
| 4 | 816 |
| 5 | 1050 |
| 6 | 620 |
| 7 | 1560 |
| 8 | 1810 |
| 9 | 810 |
| 10 | 869 |
| 11 | 570 |
| 12 | 760 |
| 13 | 594 |
| 14 | 880 |
| 15 | 910 |
| 16 | 889 |
| 17 | 350 |
| 18 | 810 |
| 19 | 810 |
| 20 | 869 |
| 21 | 880 |
| 22 | 910 |
| 23 | 680 |
| 24 | 969 |
| 25 | 1050 |
| 26 | 1480 |
| 27 | 880 |
| 28 | 610 |
| 29 | 768 |
| 30 | 895 |
| 31 | 1010 |
| 32 | 1180 |
| 33 | 1590 |
| 34 | 1260 |
| 35 | 1240 |
| 36 | 1110 |
| 37 | 742 |
| 22 | 910 |
| 23 | 680 |
| 24 | 969 |
| 25 | 1050 |
| 26 | 1480 |
| 27 | 880 |
| 28 | 610 |
| 29 | 768 |
| 30 | 895 |
| 31 | 1010 |
| 32 | 1180 |
| 33 | 1590 |
| 34 | 1260 |
| 35 | 1240 |
| 36 | 1110 |
| 37 | 742 |
| 38 | 498 |
| 39 | 1260 |
| 40 | 1110 |
| 41 | 452 |
| 42 | 511 |
| 43 | 529 |
| 44 | 338 |
| 45 | 269 |
| 46 | 369 |

TABLE 4-continued

| Metal-working Oil Composition | COD (ppm) |
|---|---|
| 47 | 411 |
| 48 | 468 |
| 49 | 501 |
| 50 | 122 |
| 51 | 962 |
| 52 | 366 |
| 53 | 327 |
| 54 | 418 |
| 55 | 911 |
| 56 | 1020 |
| 57 | 411 |
| 58 | 468 |
| 59 | 501 |
| 60 | 122 |
| 61 | 911 |
| 62 | 1020 |
| 63 | 819 |
| 64 | 1120 |
| 65 | 361 |
| 66 | 428 |
| 67 | 505 |
| 68 | 566 |
| 69 | 611 |
| 70 | 116 |
| 71 | 1280 |
| 72 | 519 |
| 73 | 553 |
| 74 | 418 |
| 75 | 539 |
| 76 | 553 |
| 77 | 539 |
| 78 | 671 |
| 79 | 387 |
| 80 | 358 |
| 81 | 269 |
| 82 | 495 |
| 83 | 365 |
| 84 | 399 |
| 85 | 425 |
| 86 | 671 |
| 87 | 387 |
| 88 | 358 |
| 89 | 399 |
| Comparative Product No. | |
| 1 | 2760 |
| 2 | 2290 |
| 3 | 3180 |
| 4 | 1980 |
| 5 | 2260 |
| 6 | 2210 |
| 7 | 2760 |
| 8 | 3010 |
| 9 | 2610 |

What is claimed is

1. A metal-working oil composition containing as essential components thereof:

(A) one or more lubricating oil components selected from the group consisting of animal and plant oils, mineral oils and fatty acid esters;

(B) a cationic or amphoteric water-soluble polymer compound having a molecular weight of 1000–1,000,000, containing nitrogen atoms in its molecule and selected from the group consisting of a homopolymer of a nitrogen-containing monomer represented by the following general formula (V)

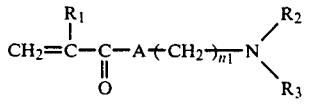

(V)

A is —O— or —NH—, $n_1$ is an integer 1–3, $R_1$ is H or $CH_3$, $R_2$ and $R_3$ are H, $CH_3$ or $C_2H_5$, independently, a copolymer of said monomer and one or more vinyl monomers selected from the group consisting of $\alpha,\beta$-unsaturated carboxylic acids, sulfo-containing vinyl compounds, acrylonitrile, vinylpyrrolidone and aliphatic olefins containing 2–20 carbon atoms, and a ring-opened polymer of ethyleneimine; and (C) a surfactant, wherein said component (A) is present in 99.8–50 wt.%, said components (B) and (C) being present in 0.1–10wt.% each, dispersed in an aqueous medium.

2. The metal working oil composition of claim 1, wherein said composition further includes an extreme-pressure additive.

3. A metal-working oil composition according to claim 2, wherein the $\alpha,\beta$-unsaturated carboxylic acid compolymerized with the nitrogen-containing monomer is acrylic acid, methacrylic acid or maleic acid.

4. A metal-working oil composition according to claim 2, wherein the sulfo-containing vinyl compound copolymerized with the nitrogen-containing monomer is vinylsulfonic acid, methallylsulfonic acid, 2-acrylamide-2-methylpropanesulfonic acid or p-styrenesulfonic acid.

5. A metal-working oil comosition according to claim 2, wherein the recurring unit of the ring-opened polymer of ethyleneimine is represented by the following general formula (XI):

$$\left[\left(CH_2CH_2-NH\right)_{n^3}\left(CH_2CH_2-\underset{\substack{|\\ CH_2CH_2NH_2}}{N}\right)_{n^4}\right] \quad \text{(XI)}$$

wherein $n^3$ means an integer of 1 to 5 and $n^4$ stands for an integer of 0 to 5.

6. A metal-working oil composition according to claim 2, wherein the extreme-pressure additive is one or more compounds selected from the following compounds (i) to (x):

(i) phosphoric acid and phosphorous acid as well as thio compounds and ester compounds thereof;

(ii) mono- and di-phosphoric acid esters containing respectively alkyl, alkylaryl and aryl groups which contain individually at least one hydroxyl group as well as thio compounds thereof;

(iii) mono- or di-phosphonic acids which contain respectively alkyl groups containing 1 to 8 carbon atoms, alkylaryl groups and aryl group and thio compounds thereof, as well as derivatives thereof;

(iv) mono- or di-phosphinic acids which contain respectively alkyl groups having 1 to 8 carbon atoms, alkylaryl groups and aryl group and thio compounds thereof, as well as derivatives thereof;

(v) mono-, di- and tri-phosphonic acids containing one or more nitrogen atoms;

(vi) thioalcohols containing alkyl groups having 1 to 8 carbon atoms or aryl group;

(vii) thiocarboxylic acids containing alkyl groups having 1 to 10 carbon atoms, hydroxyalkyl groups, alkylaryl groups or hydroxyalkylaryl groups, and salts thereof;

(viii) organozinc compounds;

(ix) $R_o$—$(S)_z$—$R_o$ wherein z stand for an integer of 1 to 5, and $R_o$ has the same meaning as that defined in the compounds (iii); and (x) organic sulfur-containing heterocyclic compounds, and salts and derivatives thereof.

7. A metal-working oil composition according to claim 6 or 2, wherein the proportion of the extreme-pressure additive ranges from 0.1 to 10 wt% of the whole composition.

8. The metal-working oil composition of claim 1, wherein said component A is mineral oil and pentaerythritol tetraoleate; said component B is a 4:5 copolymer of the phosphoric acid salt of diethylaminoethyl methacrylate and sodium methacrylate; said surfactant is polyoxyethylenenonyl phenyl ether, and said composition further comprises the amine salt of zinc dithioethylphosphate as an extreme pressure additive and 2,-4 di-t-butyl-p-cresol.

* * * * *